US007215922B2

(12) United States Patent
Terao et al.

(10) Patent No.: US 7,215,922 B2
(45) Date of Patent: May 8, 2007

(54) SHEET POST-PROCESS APPARATUS AND WAITING TRAY

(75) Inventors: Yasunobu Terao, Tagata-gun (JP); Yoshiaki Sugizaki, Sunto-gun (JP); Tomomi Iijima, Mishima (JP); Tokihiko Ise, Tagata-gun (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 299 days.

(21) Appl. No.: 11/008,142

(22) Filed: Dec. 10, 2004

(65) Prior Publication Data

US 2006/0067763 A1 Mar. 30, 2006

(30) Foreign Application Priority Data

Sep. 28, 2004 (JP) ..... 2004-281776

(51) Int. Cl.
*G03G 15/00* (2006.01)

(52) U.S. Cl. ..... 399/405; 399/407

(58) Field of Classification Search ..... None
See application file for complete search history.

(56) References Cited

U.S. PATENT DOCUMENTS

| | | | | |
|---|---|---|---|---|
| 4,473,425 | A | 9/1984 | Baughman et al. | |
| 4,611,741 | A | 9/1986 | Wilson | |
| 4,794,859 | A | 1/1989 | Huseby et al. | |
| 4,849,796 | A | 7/1989 | Murakami | |
| 4,898,374 | A | 2/1990 | Vermaat | |
| 5,021,837 | A | 6/1991 | Uto et al. | |
| 5,098,074 | A * | 3/1992 | Mandel et al. | 270/58.13 |
| 5,282,611 | A | 2/1994 | Ueda et al. | |
| 5,285,249 | A | 2/1994 | Mahoney | |
| 5,289,251 | A | 2/1994 | Mandel et al. | |
| 5,435,544 | A | 7/1995 | Mandel | |
| 5,451,037 | A | 9/1995 | Lundstrom | |
| 5,590,871 | A | 1/1997 | Okabe et al. | |

(Continued)

FOREIGN PATENT DOCUMENTS

| | | |
|---|---|---|
| JP | 62-008965 A | 1/1987 |

(Continued)

OTHER PUBLICATIONS

U.S. Appl. No 11/008,122, filed Dec. 10, 2004, Sasahara.

(Continued)

*Primary Examiner*—Anthony H. Nguyen
(74) *Attorney, Agent, or Firm*—Foley & Lardner LLP

(57) ABSTRACT

A rotary shaft is provided in association with a distal end face in a transport direction of a sheet held on a waiting tray, the sheet being retained in a waiting mode. Then, a distal end lower end support member and a paddle member are mounted coaxially, and the rotary shaft is rotated. In this manner, standby retention, retention release, and alignment processes are carried out in order. During retention in a waiting mode, the distal end lower face support member supports a sheet distal end lower face. During release of the retention, this support member releases the support of the sheet distal end lower face. During the sheet alignment process, the alignment paddle member carries out alignment processing of the distal end in the transport direction of the sheet dropped onto a processing tray.

6 Claims, 14 Drawing Sheets

U.S. PATENT DOCUMENTS

| | | | | |
|---|---|---|---|---|
| 5,628,502 | A | 5/1997 | Amarakoon | |
| 5,676,517 | A | 10/1997 | Lotz | |
| 5,709,376 | A | 1/1998 | Ushirogata | |
| 5,934,140 | A | 8/1999 | Jackson et al. | |
| 5,961,274 | A | 10/1999 | Bors | |
| 5,971,384 | A | 10/1999 | Asao | |
| 6,065,747 | A | 5/2000 | Khovaylo et al. | |
| 6,092,948 | A | 7/2000 | Altfather | |
| 6,142,461 | A | 11/2000 | Asao et al. | |
| 6,179,287 | B1 * | 1/2001 | Watanabe et al. | 271/215 |
| 6,231,039 | B1 | 5/2001 | Chung | |
| 6,330,999 | B2 | 12/2001 | Coombs et al. | |
| 6,336,630 | B1 | 1/2002 | Holtman et al. | |
| 6,354,059 | B1 | 3/2002 | Yoshie et al. | |
| 6,357,753 | B1 | 3/2002 | Yamasaki et al. | |
| 6,450,934 | B1 | 9/2002 | Coombs | |
| 6,581,922 | B2 | 6/2003 | Kuwata et al. | |
| 6,641,129 | B2 | 11/2003 | Ogita et al. | |
| 6,659,455 | B2 | 12/2003 | Endo et al. | |
| 6,671,492 | B2 | 12/2003 | Mimura et al. | |
| 6,698,744 | B2 | 3/2004 | Yamada et al. | |
| 6,712,349 | B2 | 3/2004 | Watanabe | |
| 6,722,646 | B2 | 4/2004 | Sekiyama et al. | |
| 6,722,650 | B1 | 4/2004 | Abbata et al. | |
| 6,733,006 | B2 | 5/2004 | Kobayashi et al. | |
| 6,733,007 | B2 | 5/2004 | Sekiyama et al. | |
| 6,767,012 | B2 | 7/2004 | Sasamoto | |
| 6,819,906 | B1 | 11/2004 | Herrmann et al. | |
| 6,824,128 | B2 | 11/2004 | Nagata et al. | |
| 6,871,042 | B2 | 3/2005 | Nemura et al. | |
| 6,910,686 | B2 | 6/2005 | Awano | |
| 6,928,259 | B2 | 8/2005 | Sakuma | |
| 6,988,728 | B2 | 1/2006 | Kida | |
| 2002/0047233 | A1 | 4/2002 | Coombs et al. | |
| 2002/0053766 | A1 | 5/2002 | Kubota | |
| 2002/0163119 | A1 | 11/2002 | Kawata | |
| 2003/0057625 | A1 | 3/2003 | Kuwata et al. | |
| 2004/0113348 | A1 | 6/2004 | Awano | |
| 2004/0126163 | A1 | 7/2004 | Asami et al. | |
| 2004/0181308 | A1 | 9/2004 | Hayashi et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 2583594 | B2 | 11/1996 |
| JP | 2000-247529 | A | 9/2000 |
| JP | 2001-089009 | A | 4/2001 |
| JP | 2003-081517 | A | 3/2003 |

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,290, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.

* cited by examiner

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-281776, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese patent document 1: Jpn. Pat. Appln. KOKAI Publication No. 2000-247529 discloses a paddle mechanism having a paddle portion for retaining a top face of a sheet. However, there is not disclosed a construction for making a paddle member coaxial to a member for supporting a lower face of a sheet. Therefore, this paddle mechanism is different from that of the present invention in technical idea, and advantageous effect of the present invention cannot be attained.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space. As a result, a post-process apparatus can be made compact. Moreover, it is possible to sent the sheets to the processing tray without any malfunction.

In this case, although it is necessary to align a distal end of sheets dropped on the processing tray, equipment can be easily large sized by additionally providing such a function.

It is an object of the present invention to provide a sheet processing apparatus and a waiting tray enabling space reduction and high density packaging with inexpensive equipment.

In order to solve the above described problem, the present invention comprises the following features.

1. A sheet post process apparatus, the apparatus comprising:

a waiting tray to temporarily retain a transported sheet in a waiting mode and release the support to drop the sheet;

a processing tray to align and hold the sheet dropped from the waiting tray; and a storage tray to hold the sheet processed by the processing tray, wherein the waiting tray comprises:

left and right lower face support members which support left and right lower faces in a sheet transport direction during retention in a waiting mode and release the support of a sheet distal end lower face of the left and right lower faces during release of the retention;

a distal end lower face support member which supports a distal end lower face in a sheet transport direction during retention in a waiting mode and releases the support on the sheet distal end lower face during release of the retention;

an alignment paddle member which aligns distal ends of the sheets held on the processing sheet during sheet alignment on the processing tray; and a rotary shaft allocated in association with a distal end face in the transport direction of the sheet retained in a waiting mode, and the rotary shaft moves the distal end lower face support member from a standby retention location to a retention release location by coaxially mounting and rotating the distal end lower face support member and paddle member, and moves the paddle member to a location in which the sheets are aligned.

2. A sheet post process apparatus according to 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are short in length of a sheet transport direction thereof than a length of a standard sheet to be held, and a part of the proximal end side in the transport direction of the sheet to be held on the processing tray is held on the storage tray.

3. A waiting tray for use in a sheet post process apparatus, for temporarily retaining a transported sheet in a waiting mode and releasing the support to drop the sheet onto a processing tray, the waiting tray comprising:

left and right lower face support members which support left and right lower faces in a sheet transport direction during retention in a waiting mode and release the support of a sheet distal end lower face of the left and right lower faces during release of the retention;

a distal end lower face support member which supports a distal end lower face in a sheet transport direction during retention in a waiting mode and releases the support on the sheet distal end lower face during release of the retention;

an upper face slash member which slashes a sheet distal end upper face in a direction to the processing tray during release of the retention; and a rotary shaft allocated in association with a distal end face in a transport direction of a sheet retained in a waiting mode, wherein the rotary shaft moves the distal end lower face support member from a standby retention location to a retention release location by coaxially mounting and rotating the distal end lower face support member and paddle member, and moves the paddle member to a location in which the sheets are aligned.

4. A waiting tray according to 3, wherein the paddle member is made of a soft elastic member, and, in the sheet alignment processing location, the paddle member comes into contact with the sheet on the processing tray in an elastically curved state, and aligns a distal end at a side opposite to the sheet transport direction.

5. A waiting tray according to 3, wherein the distal end lower face support member and the paddle member are allocated on the same peripheral face of the rotary shaft at an angle of 180 degrees.

6. A sheet post process apparatus, the apparatus comprising:

waiting means for temporarily retaining a transported sheet in a waiting mode and releasing the support to drop the sheet;

processing means for aligning and holding the sheet dropped from the waiting means; and storage means for holding the sheet processed by the processing means, wherein the waiting means comprises:

left and right lower face support means for supporting left and right lower faces in a sheet transport direction during retention in a waiting mode and releasing the support of a sheet distal end lower face of the left and right lower faces during release of the retention;

distal end lower face support means for supporting a distal end lower face in a sheet transport direction during retention in a waiting mode and releasing the support on the sheet distal end lower face during release of the retention;

alignment means for aligning distal ends of the sheets held on the processing means during sheet alignment on the processing means; and a rotary shaft allocated in association with a distal end face in the transport direction of the sheet retained in a waiting mode, and the rotary shaft moves the distal end lower face support member from a standby retention location to a retention release location by coaxially mounting and rotating the distal end lower face support member and paddle member, and moves the paddle member to a location in which the sheets are aligned.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

According to the present invention, a distal end lower face support member for supporting a distal end lower face in a transport direction of a sheet retained in a waiting mode is provided together with left and right lower face support members for supporting left and right lower faces in the transport direction of the sheet retained in a waiting mode. Thus, even if a sheet to be retained in a waiting mode is soft, the sheet can be prevented from accidentally slipping off from a waiting tray.

Further, when retention in a waiting mode is released to drop a sheet on a processing tray, the retention of distal end lower face support members is released, and the retention of the left and right lower face support members is released. Then, by providing a paddle member, the dropped sheet is pulled to the distal end side of the processing tray by the paddle member, whereby alignment of the sheet distal end can be carried out.

Space reduction can be achieved by coaxially providing the distal end retainer member and the paddle member. In addition, parts having additional functions can be used in one combination, thereby making it possible to achieve cost reduction. Further, only one drive motor may suffice, thus making it possible to provide inexpensive equipment.

The distal end retainer member is made of a resin, whereby a sheet can be stably dropped without being trapped. The paddle member is made of an arm shaped soft rubber, and can be significantly slackened. The pulling (alignment) of the sheet distal end can be stably carried out regardless of the number of sheets held on the processing tray. Further, the paddle member can be mounted because it is slackened and released even if the paddle is allocated in location where a dense mechanism exists (for example, in location in which a rotary shaft or the like is installed).

DETAILED DESCRIPTION OF THE INVENTION

Now, one embodiment of the present invention will be described here.

(General Description of Image Forming Apparatus)

Figure 18:
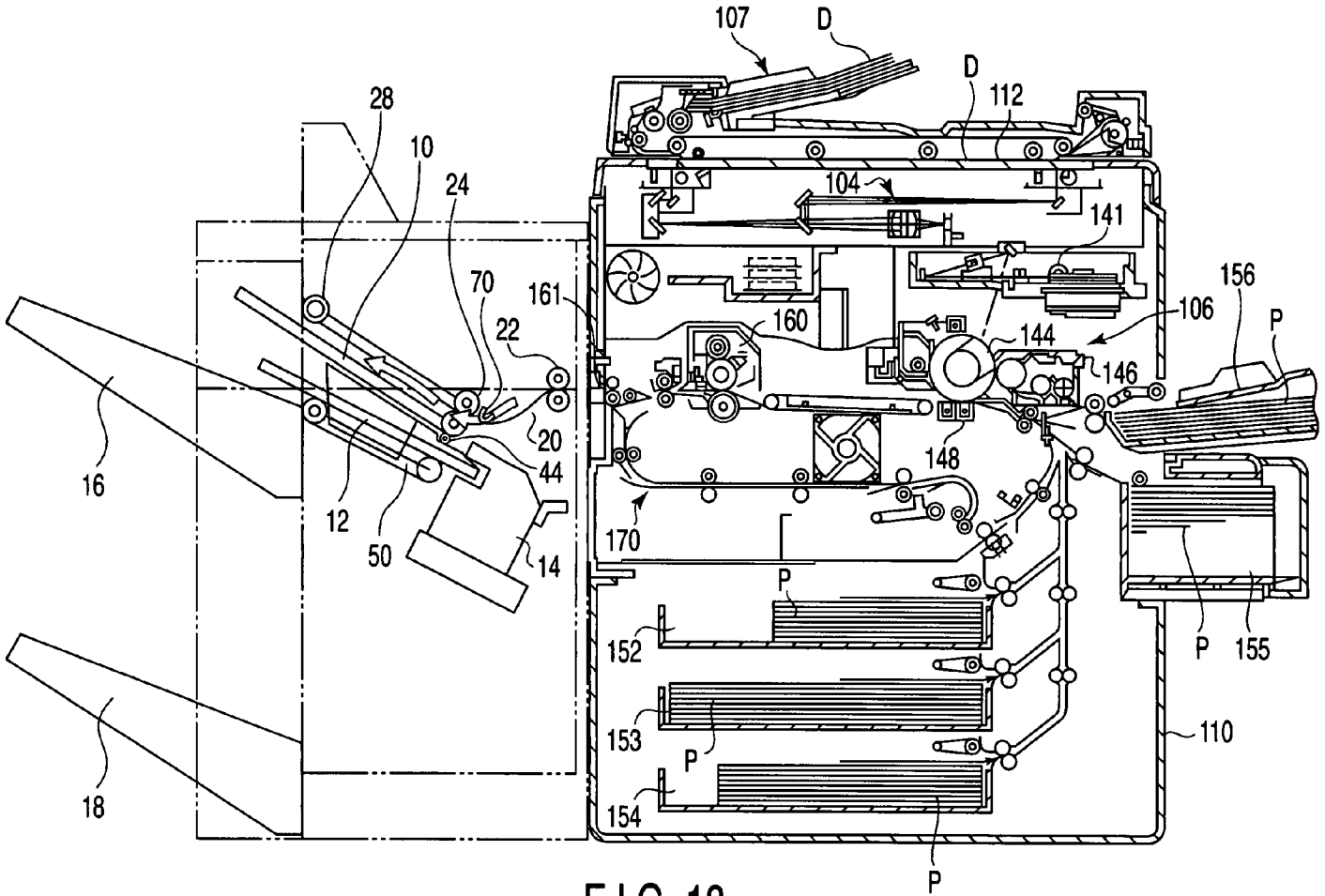
FIG. 18 is a view showing a combination of the post-process apparatus and the image forming apparatus according to the present invention.

A general description of an image forming apparatus (digital copying machine) allocated at a front stage of a post-process apparatus according to the present invention will be given with reference to FIG. 18. A manuscript placement base 112 is provided at an upper face of this apparatus. An auto document feeder 117 (hereinafter, referred to as an ADF) for automatically feeding a document D onto the manuscript placement base 112 is allocated on the manuscript placement base. The manuscript D is placed on the ADF, predetermined settings (such as the presence of absence of staple processing, how to carry out staple processing, the number of copies, or size of sheet to be copied, for example), and then, a copy start button is pressed. The manuscript D on the ADF is transported to a predetermined location of the manuscript placement base 112.

A scanner unit 4, a printer unit 6, and a copy sheet cassette and feeder are arranged at the inside of the image forming apparatus. At the scanner unit 4, the manuscript D on the manuscript placement base 112 is scanned, and reflection light thereof is incident. The incident reflection light is converted in a photoelectric manner, image information on the manuscript D is read, and a photoelectric signal corresponding to the read image information is output. At the printer unit 6, according to the image information or the like on the manuscript D read by the scanner unit 4, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 of the copy sheet P, and the toner image on the photo-sensitive drum 144 is copied onto the copy sheet by a transfer charger 148. Then, the toner image of the copy sheet is fixed by a fixing device 160, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is entered by operator's data input and/or an input signal from sensor means provided in the image forming apparatus. The control circuit at the image forming apparatus side sends information concerning a sheet transported to the control circuit of the post-process apparatus side based on these items of information. The information includes the following. For example, the sheet is provided as a sheet retained in the waiting tray in a waiting mode, the sheet being a sheet other than a last sheet to be held. The sheet is provided as a sheet retained in the standby sheet in a waiting mode, the sheet being a last sheet to be held. The sheet is provided as a sheet retained in the waiting tray in a waiting mode (a sheet being directly dropped on the processing sheet). The sheet is provided as a sheet being directly ejected to the storage tray without being dropped on the waiting tray. Information concerning dimensions of a sheet to be transported to the post-process apparatus (such as A3 or A4 size, for example) or sheet length (such as ordinary paper or a variety of cardboards, for example) is also sent from a control circuit at the image forming apparatus side to a control circuit at the post-process apparatus side.

Information concerning a length of a sheet which is larger than that of a set sheet is sensed by a sensor provided in the post-process apparatus. The sensed information is sent from this sensor to the control circuit at the post-process apparatus side.

(General Description of Post-process Apparatus)

A general description of the post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with the ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported), and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper storage tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. Since the waiting tray 12 is small in size than a sheet to be held thereon, when a sheet is dropped from the waiting tray 10 to the processing tray 12, that sheet is held across the processing tray 12 and the storage tray 16 (or 18) (refer to FIGS. 10 to 13).

A control circuit of the post-process apparatus controls the waiting tray 10 to make a proper operation based on information concerning a sheet obtained from the control circuit at the image forming apparatus side and information available from the sheet sensor 70.

For example, when a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
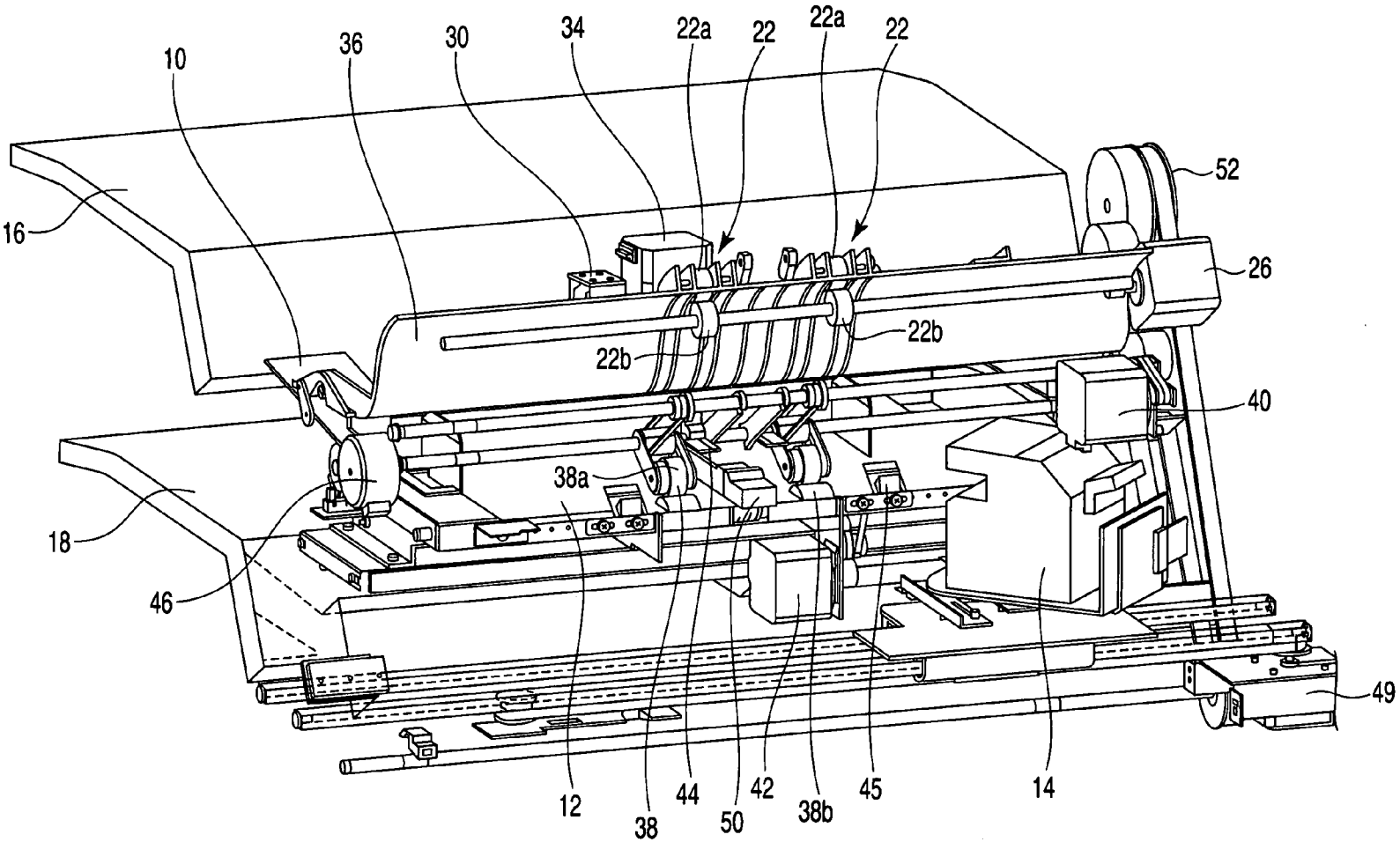
FIG. 1 is a perspective view of a post-process apparatus showing one embodiment of the present invention.
Figure 2:
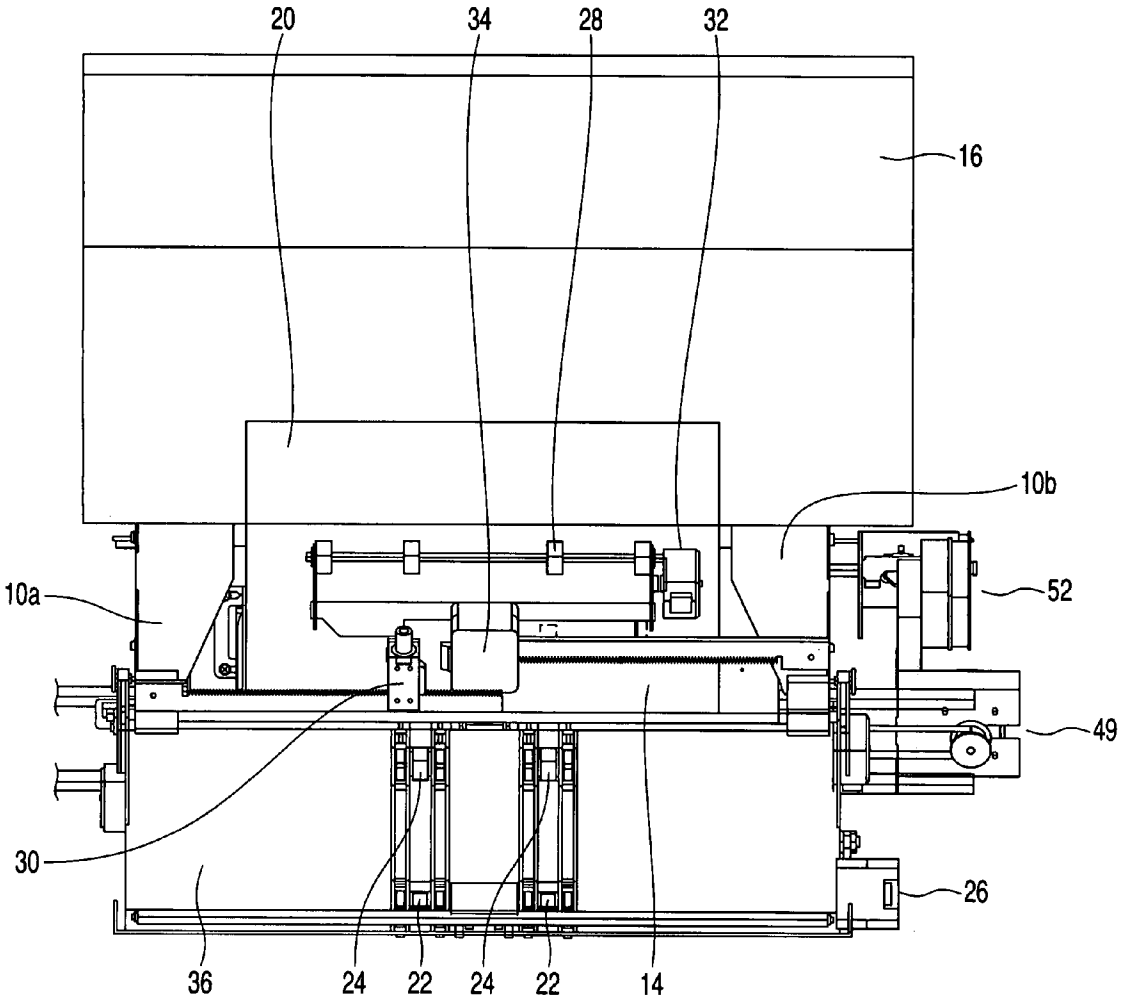
FIG. 2 is a top view of the post-process apparatus showing one embodiment of the invention.
Figure 3:
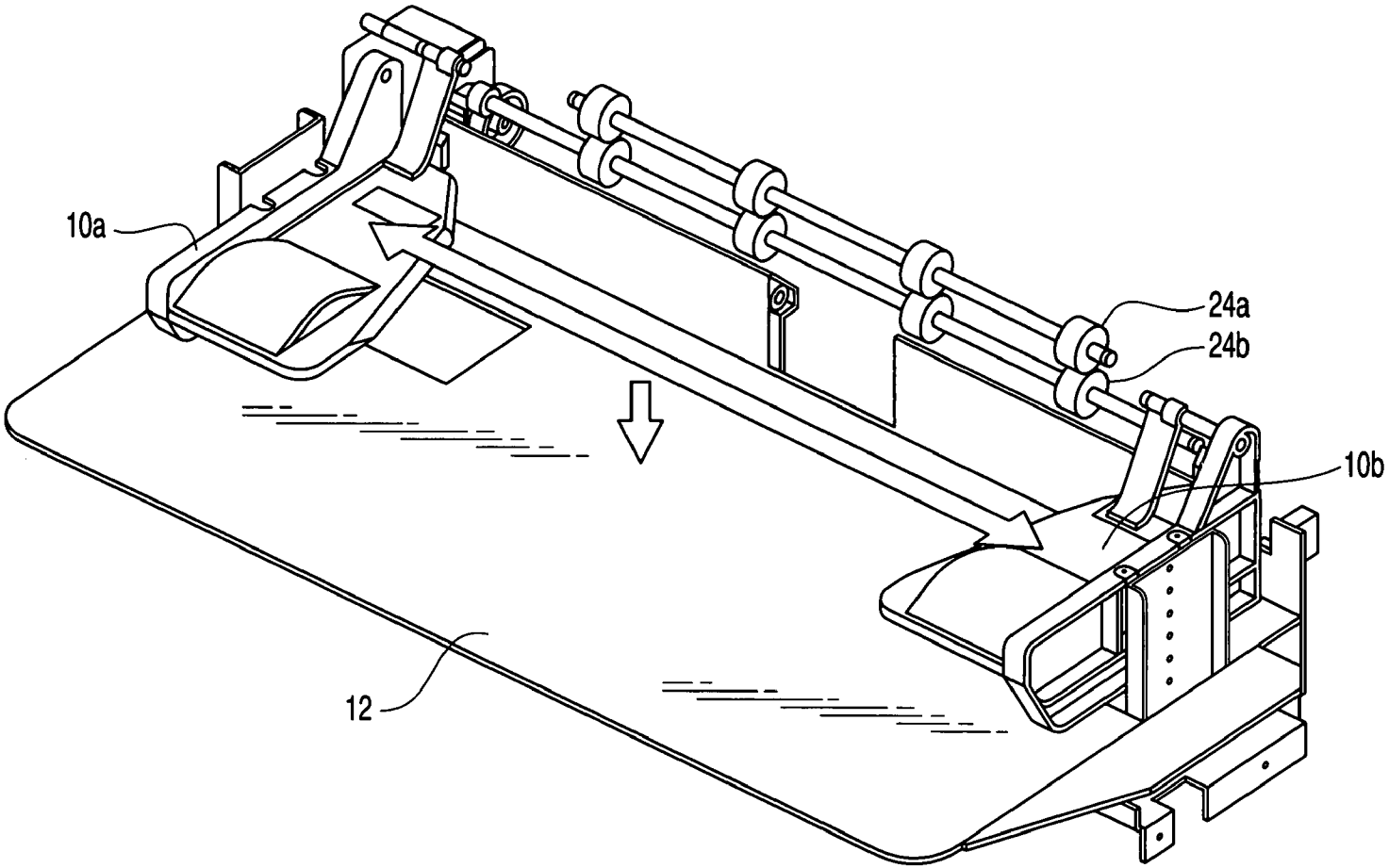
FIG. 3 is a view illustrating an operation of a waiting tray showing one embodiment of the invention.

The waiting tray will be described with reference to FIGS. 1, 2 and 3. As has been already described, when a preceding sheet is staple processed on the processing tray 12, a next sheet cannot be dropped on the processing tray. The waiting tray 10 is intended for make the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This operation is controlled by a waiting tray roller drive source 30. The waiting tray roller 28 enables normal and invert rotation. This normal and invert rotation is carried out by a waiting tray roller motor 32.

On the waiting tray 10, left and right lower face support members 10*a* and 10*b* for supporting both sides of the lower face of a sheet carried into the waiting tray are provided in the left and right widthwise direction. A space between the left and right lower face support members is open. Therefore, a center section of the sheet lower face is not supported. The upper faces of these left and right lower face support members 10*a* and 10*b* each are formed in a flat shape, and a curved face which is upwardly curved is formed at its top end side. Instead of this curved face or together with the curved face, a roller which is rotatable in an arbitrary direction may be engaged. The left and right lower face support members 10*a* and 10*b* are formed to be wide in width of its proximal end side and to be narrow in width of its distal end side. As a result, the width of an opening portion formed between both of the lower face support members is formed to be wide at its proximal end side and to be narrow at its distal end side. The width used here denotes a transverse direction in the case where a sheet transport direction is defined as a longitudinal direction. The left and right lower face support members 10*a* and 10*b* are set in a location in which a sheet side face can be fully supported by the left and right lower face support members when a sheet is retained in a waiting mode. On the other hand, when the retention in a waiting mode is released, these support members are set in a location for releasing the left and right lower face support members 10*a* and 10*b*. When the left and right support members 10*a* and 10*b* exist in this location, the sheet can be dropped from its distal end to the processing tray 12. The left and right lower face support members 10*a* and 10*b* are driven by a waiting tray motor 34. By means of this waiting tray motor 34, the left and right lower face support members are operated to be slid to adjust the opening width of the opening portion, and the left and right lower face support members 10*a* and 10*b* are opened and closed.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back. In addition, also in the case where the sheets are transported from the waiting tray directly to the storage tray, the waiting roller is lowered and is rotated while the sheets are compressed, and the sheets are ejected. In this case, the rotation direction of the waiting tray roller 28 becomes inverted from that in the case where the sheets are abutted against the distal end side.

On the waiting tray 10, there is provided the sheet sensor 70 (refer to FIG. 18 or the like) for sensing a sheet to be proximal to the paper feed roller 24, i.e., at a side (upstream side) at which a sheet is carried in the waiting tray. This sheet sensor 70 senses the start of transport (sheet proximal end) by the paper feed roller 24 and the end of transport (sheet distal end) by the sheer feed roller 24. This sense signal is fed to control means of the post process apparatus.

Figure 19:
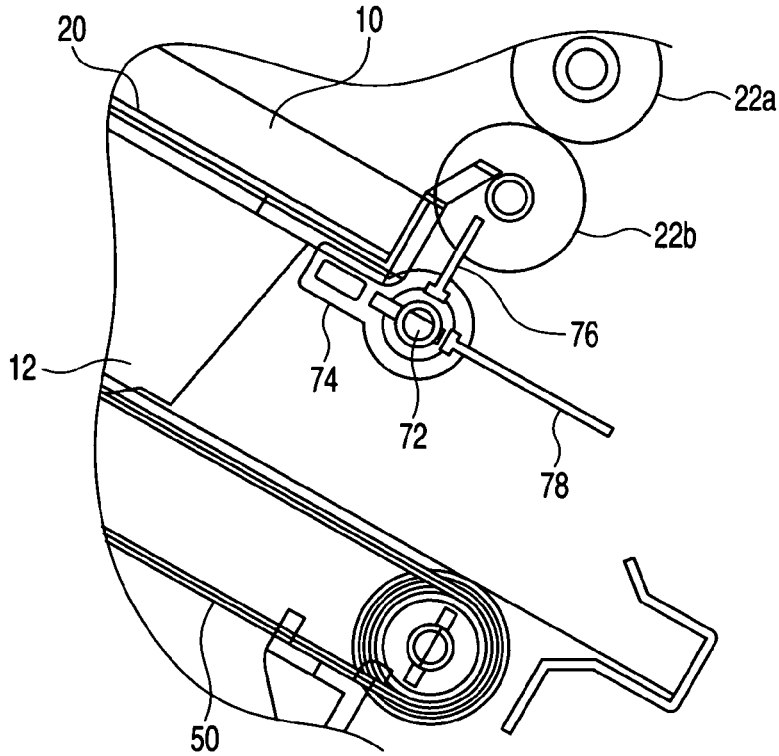
FIG. 19 is a view showing actuation of the waiting tray showing one embodiment of the present invention, the view showing a state in which a distal end retainer member retains a sheet distal end.
Figure 20:
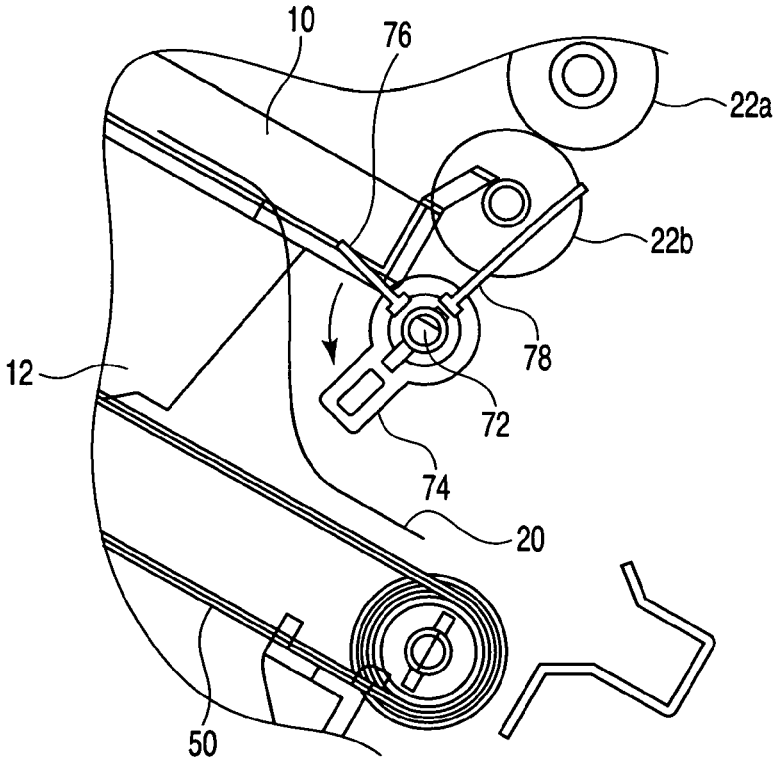
FIG. 20 is a view showing actuation of the waiting tray showing one embodiment of the present invention, the view showing a state in which an upper face slash member slashes a sheet distal end upper face.
Figure 21:
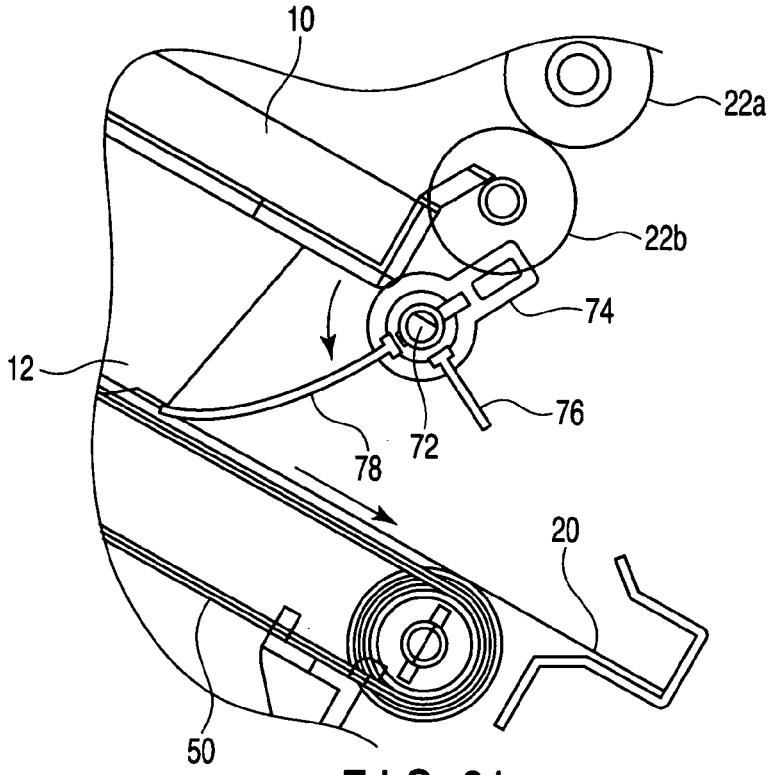
FIG. 21 is a view showing actuation of the waiting tray showing one embodiment of the present invention, the view showing a state in which a sheet distal end is aligned by a paddle member.

FIGS. 19 to 21 are enlarged views showing a rear side of the waiting tray 10. Below the inlet roller 22, a rotary shaft 72 is arranged along a distal end face of a sheet to be retained in a waiting mode. On this rotary shaft 72, a distal end lower face support member 74, an upper face slash member 76, and a paddle member 78 are coaxially allocated to be projected with predetermined intervals in a peripheral direction. (In this example, the distal end lower face support member 74 and the upper face slash member 76 are allocated in order with predetermined intervals at an angle of 90 degrees, and the upper face slash member 76 and the paddle member 78 are allocated in order with intervals at an angle of 90 degrees). When a sheet is retained in a waiting mode, the distal end lower face support member 74 is set in a location for supporting a sheet distal end lower face (preferably, a center portion of the sheet), as shown in FIG. 19. On the other hand, when retention of the sheet is released, this support member is moved in a downward direction as shown in FIG. 20 so as to release the support of the distal end lower face. This distal end lower face support member is made of a resin or the like. The upper face slash member 76 is located upwardly to be spaced from a sheet during retention in a waiting mode. However, during release of the retention, as shown in FIG. 20, this slash member rotates downwardly to slash the sheet upper face so as to forcibly drop the sheet onto the processing tray 12. This upper face slash member 76 is made of a soft rubber or the like. The alignment paddle member 78 carries out alignment processing of a distal end in a transport direction of the sheet dropped into the processing tray 12. While in retention in a waiting mode, this paddle member is located on the opposite side of the distal end lower face support member 74. While in a release of the retention, the paddle member is located upwardly of the sheet. Further, when the sheet alignment processing shown in FIG. 21 is carried out such that the rotary shaft has rotated from a standby retention state by 180 degrees, the paddle member comes into contact with the sheet upper face held on the processing tray 12 in a curved state. In this state, the sheets are pushed down to the distal end side, and the sheets are aligned with the distal end in the transport direction. This paddle member 78 is made of a soft rubber, and has a length sufficient to come into contact with the sheet upper face on the processing tray in a curved state. The paddle member 12 is made of a soft rubber or the like, and therefore, even if the paddle member comes into contact with another device of the post process apparatus during rotation (for example, the drive shaft of the paper feed roller), the paddle member is curved to bypass it. Therefore, another device is not damaged, and the rotation of the paddle member is not adversely affected. When such a sheet alignment process terminates, the rotary shaft 72 returns to its original location in which the distal end lower face support member 74 shown in FIG. 19 retains the lower face of a sheet.

Figure 22:
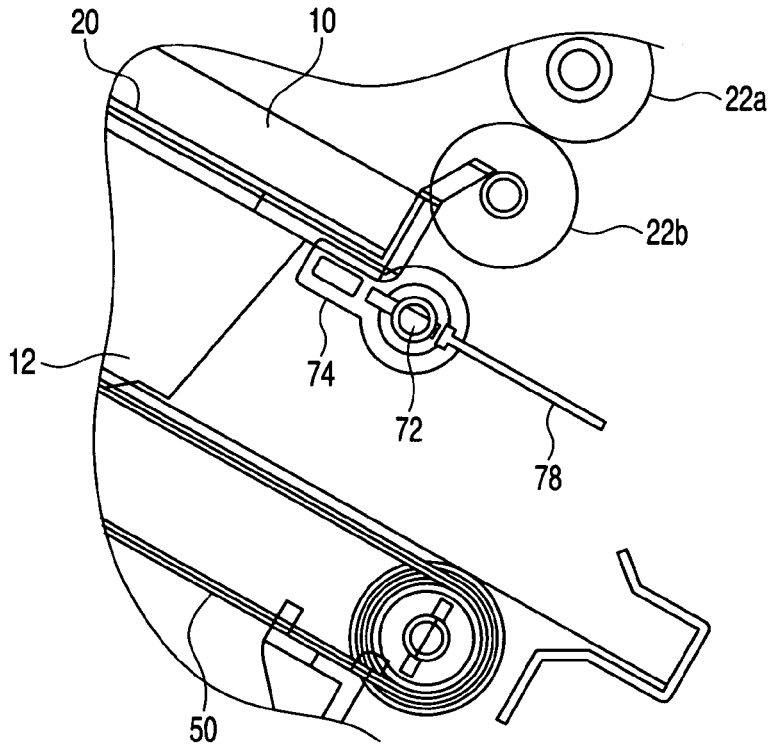
FIG. 22 is a view showing another embodiment of the waiting tray according to the present embodiment.

In the present embodiment, although the upper face slash member 76 and the paddle member 78 are provided on the rotary shaft 72 together with the distal end retainer member 74, the present invention is not limited to these members. For example, as shown in FIG. 22, even if there is provided a structure that no upper face slash member is provided on the rotary shaft 72, an object of the present invention can be achieved.

<Processing Tray>

The processing tray 12 carries out longitudinal or transverse alignment with respect to bundles of sheets dropped from the waiting tray 10, and carries out predetermined processing (for example, staple processing). This processing tray is allocated in a inclined shape which is high at the proximal end side and which is low at the distal end side.

Figure 4:
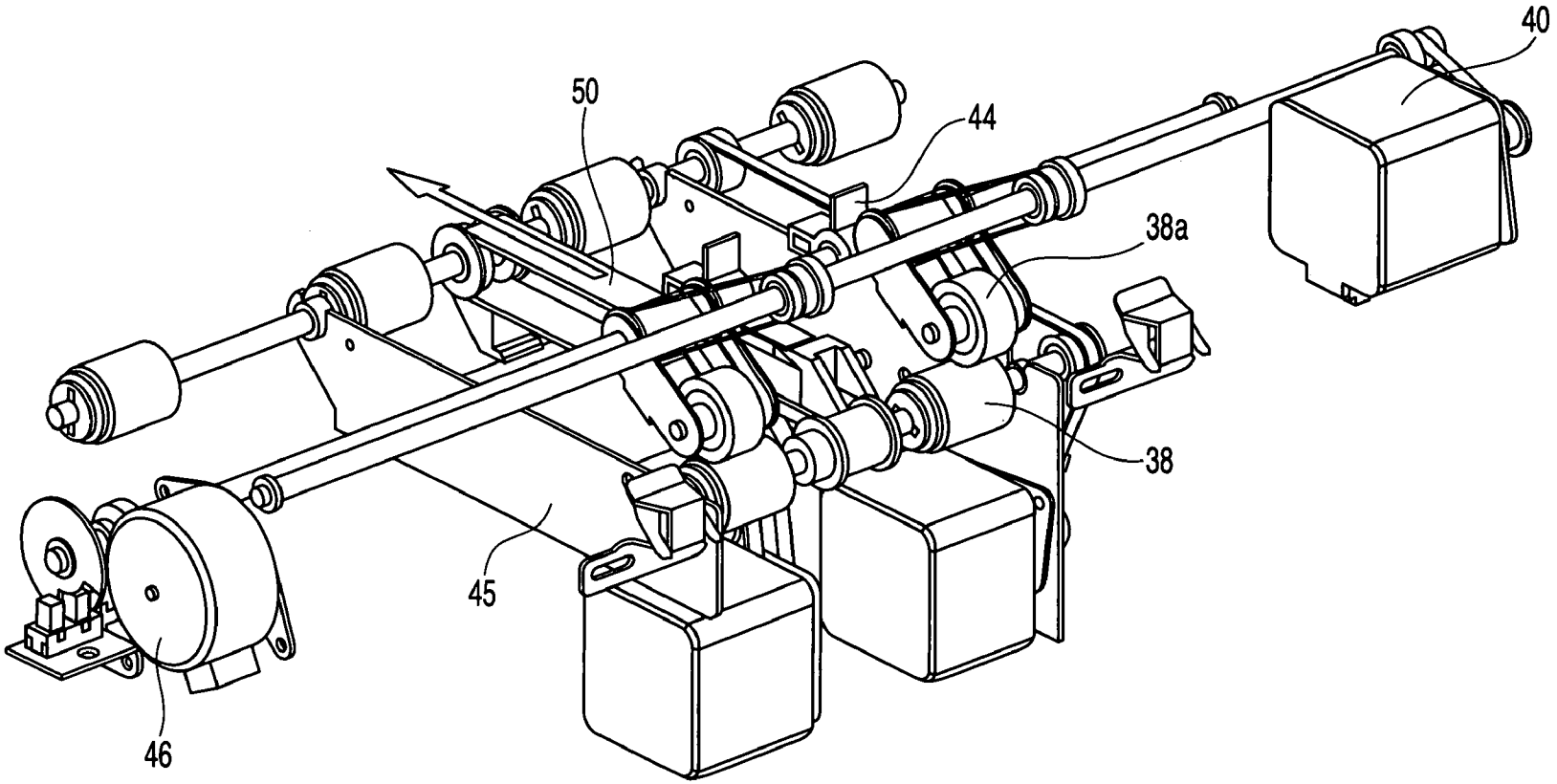
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40. A longitudinal alignment lower roller 38*b* is driven by a longitudinal alignment lower roller motor 42. Sheets are aligned while a stopper 45 is defined as a reference. In addition, in order to assist this alignment, a paddle 44 is provided. This paddle 44 is driven by a paddle motor 46.

Figure 5:
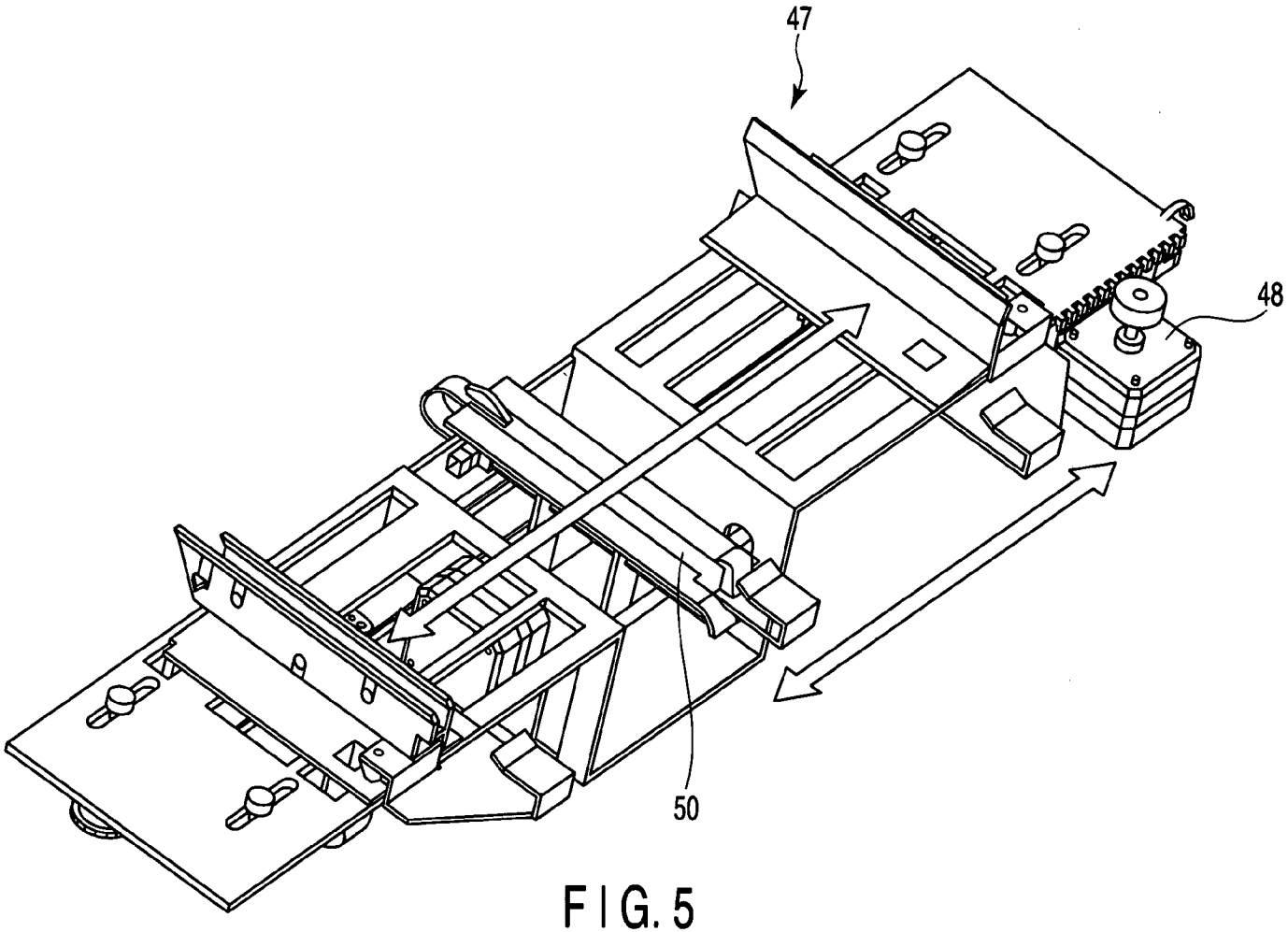
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

When a predetermined number of sheets are aligned and held on the processing tray 12, staple processing is carried out by the stapler 14.

Figure 6:
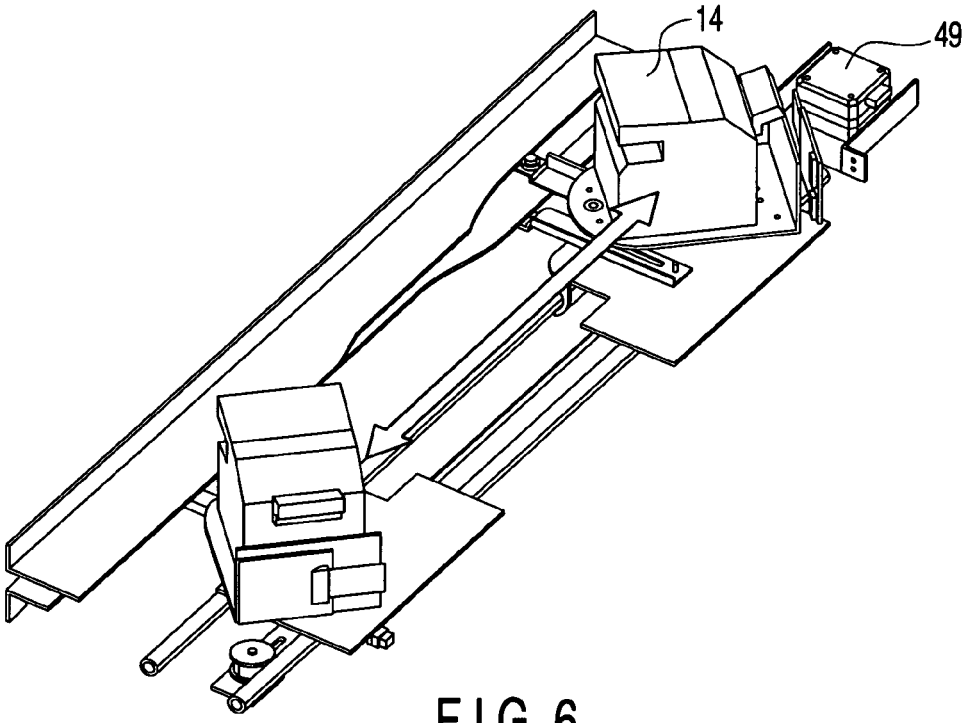
FIG. 6 is a view illustrating an operation of a stapler of the post-process apparatus showing one embodiment of the invention.
Figure 7:
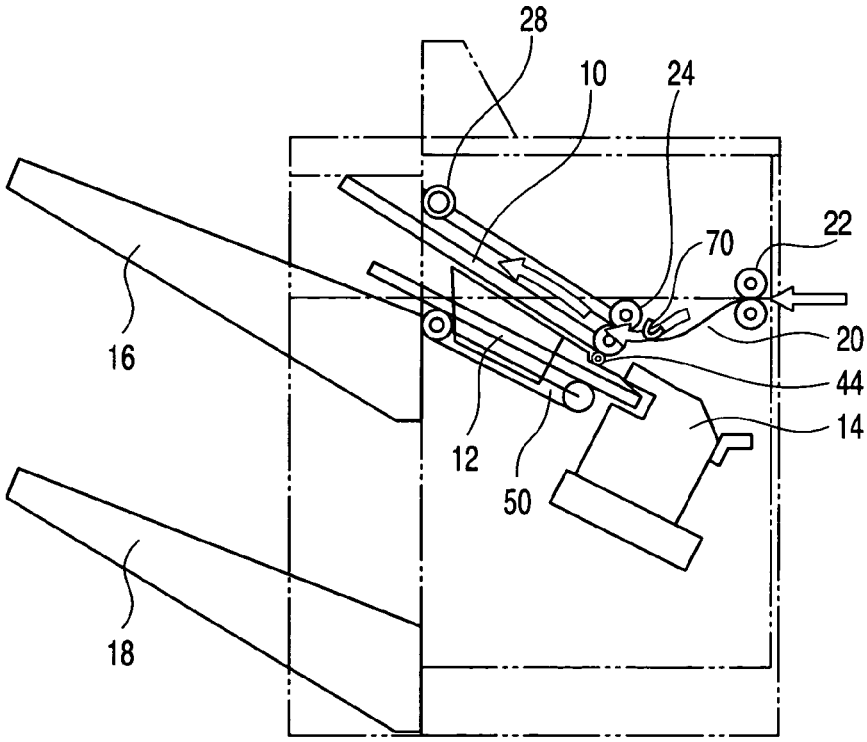
FIG. 7 is a view illustrating a flow of a first sheet of sheets between an inlet roller and a paper feed roller in the post-process apparatus showing one embodiment of the invention.
Figure 8:
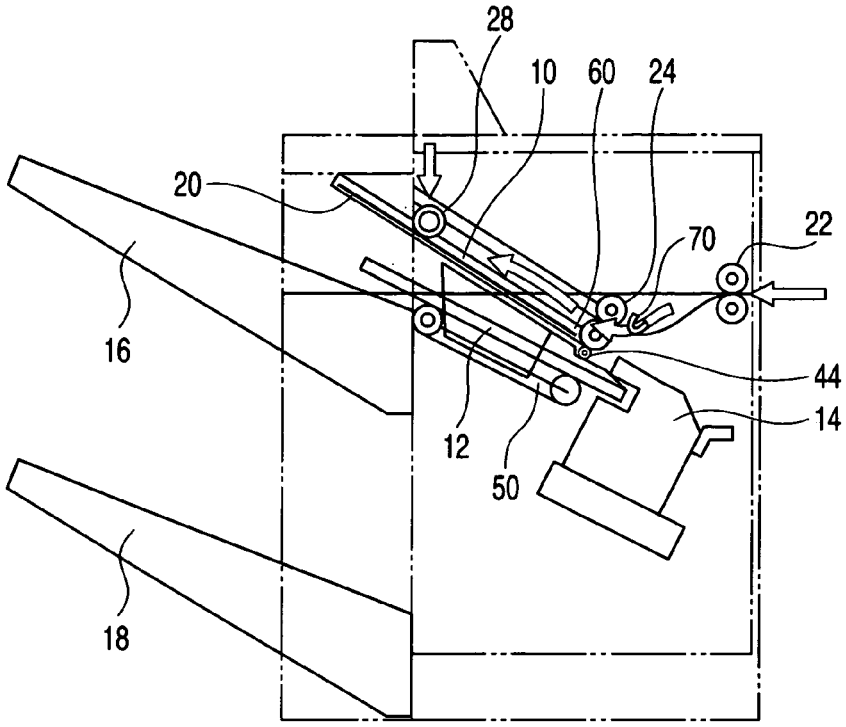
FIG. 8 is a view illustrating a flow of a first sheet of sheets between the paper feed roller and a standby roller in the post-process apparatus showing one embodiment of the invention.
Figure 9:
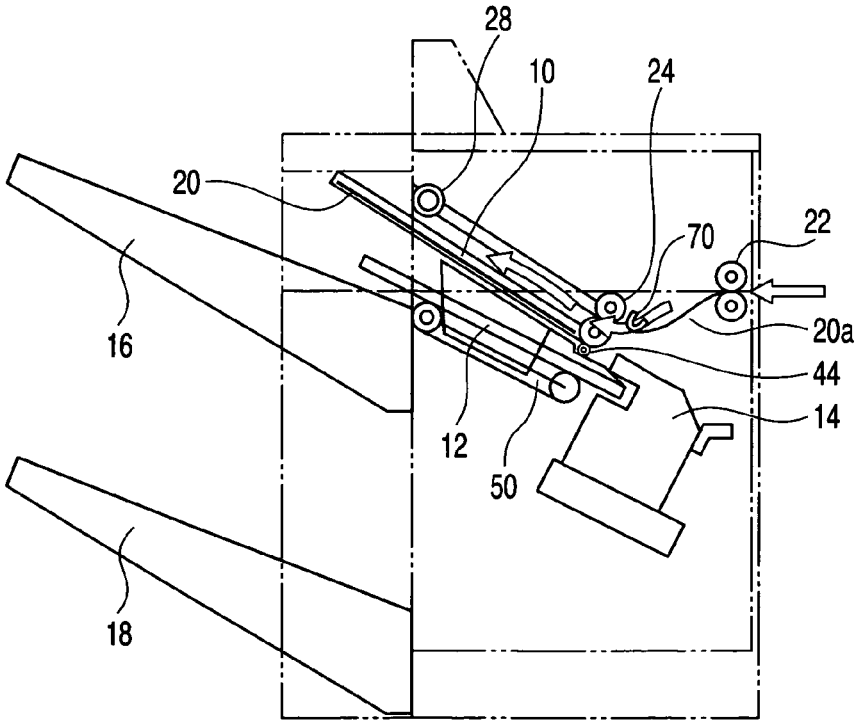
FIG. 9 is a view illustrating a flow of a second sheet of sheets between the paper feed roller and the standby roller in the post-process apparatus showing one embodiment of the invention.
Figure 10:
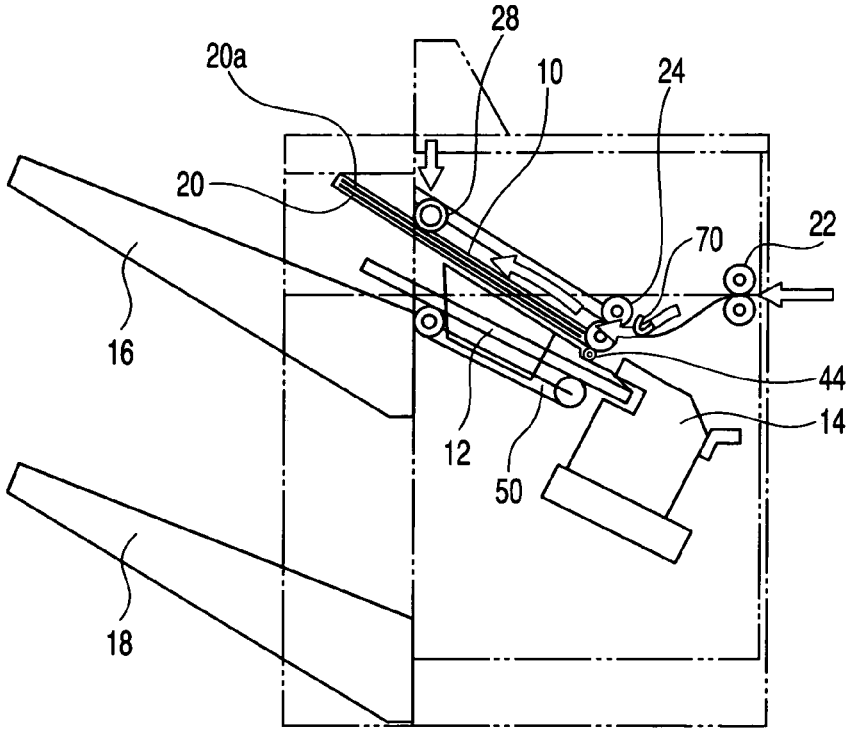
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, the staple processed bundles of sheets are sent to the storage tray 16 by the transport mechanism 50. Selection of the storage tray 16 or 18 is made by vertically moving the storage tray 16 or 18 by a storage tray drive unit 52.

In the case where sheets are directly ejected from the waiting tray 10, the storage tray is risen up to a location which corresponds to a sheet outlet of the waiting tray.

(Description of Operation)

Now, an operation of the post process apparatus according to the present invention will be described with reference to FIGS. 7 to 18.

<Operation in Case Where Staple Processing is Carried Out>

As has been already described, staple processing on the processing tray is slow as compared with that on the image processing apparatus. Thus, when a sheet transported from the image processing apparatus is processed on the processing tray, a buffer unit is provided at the front stage thereof. Then, it is necessary to make a next sheet standby not so as to be transported to the processing tray until the staple processing on the processing tray has completed. In this example, a description will be given with respect to a case in which two sheets (first and second sheets) are made standby on the waiting tray, and the third and subsequent sheets are not required to be made standby.

A first sheet from the image processing apparatus is transported to the waiting tray 10 via the inlet roller 22 and the paper feed roller 24. The sheet is retained by the left and right lower face support members 10*a* and 10*b* and the distal end support member 74 which are set at a first position; the waiting tray roller 28 is lowered, and the sheet distal end is aligned (this alignment is made with the distal end 60 of the waiting tray 10 (upstream side)).

Figure 11:
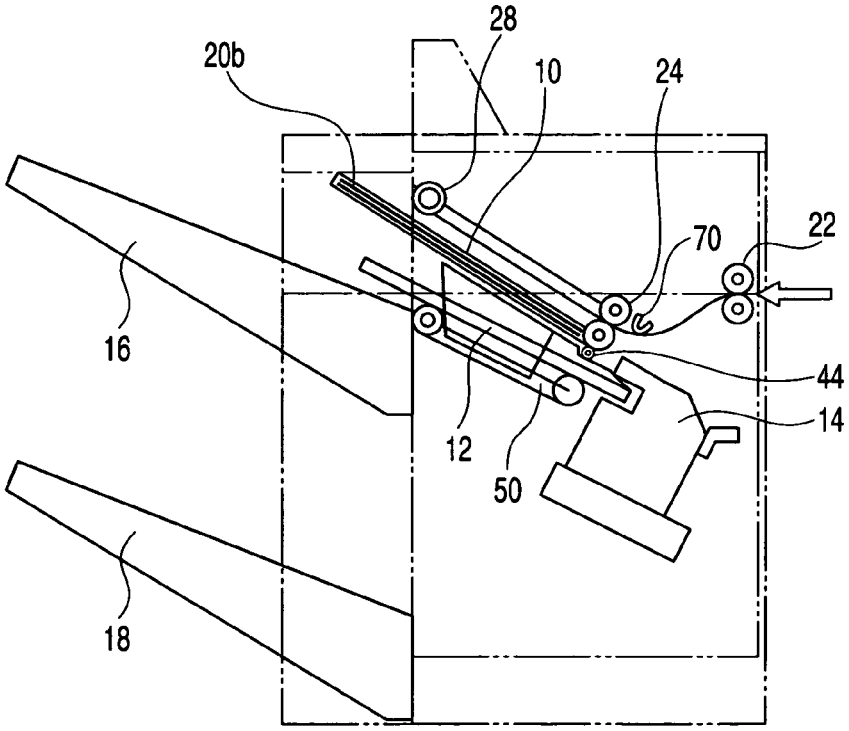
FIG. 11 is a view illustrating an operation of the waiting tray roller in the post-process apparatus showing one embodiment of the invention.
Figure 12:
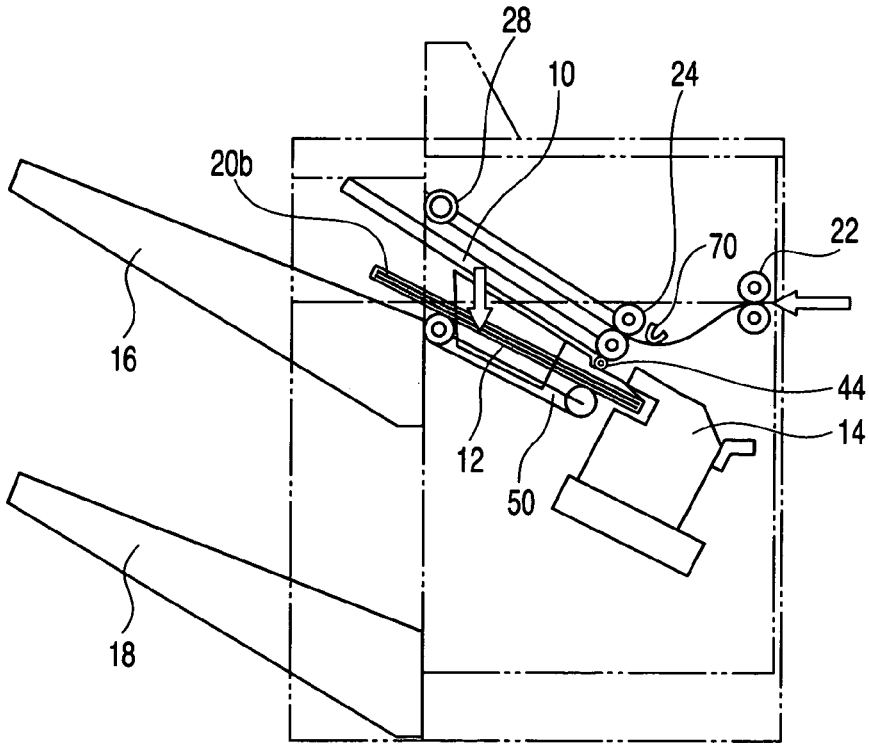
FIG. 12 is a view illustrating an operation of an active drop in the post-process apparatus showing one embodiment of the invention.

Next, the waiting tray roller 28 is risen, and is ready for accepting a second sheet 20*a*. When the second sheet 20*a* is sent to the waiting tray 10, the waiting tray roller 28 is lowered to align a location of the sheet with the distal end 60 of the waiting tray 10. Then, the waiting tray roller 28 is risen (FIG. 11). When the second sheet is transported to the waiting tray, the distal end portion of the sheet is sensed by the sheet sensor 70. When the first and second sheets are held on the waiting tray, the bundles of these sheets are dropped onto the processing tray 12 altogether.

That is, the left and right lower face support members 10*a* and 10*b* are released to be located at a second position so as to release support of both sides of the sheet. At this time, the rotary shaft 72 is rotated at the same time. With this rotation, an operation for releasing the retention of the distal end retainer member 74 and an operation for slashing the sheet distal end upper face by the upper face slash member 76 are carried out at the same time, forcibly dropping the sheet onto the processing tray. Then, the distal end in the transport direction of the sheets dropped on the processing tray 12 is aligned by the alignment paddle member 78. In this manner, the standby retention, retention release, and alignment processes can be sequentially carried out by a rotating operation of one rotary shaft. After these processes have terminated, the rotary shaft 72 returns to its original location in which the sheet distal end is retained by the distal end retainer member 72.

Then, with respect to the third and subsequent sheets, the waiting tray is kept in a state in which the support of the sheet is released, and the sheet is transported from the paper feed roller 24 directly to the waiting tray.

Figure 13:
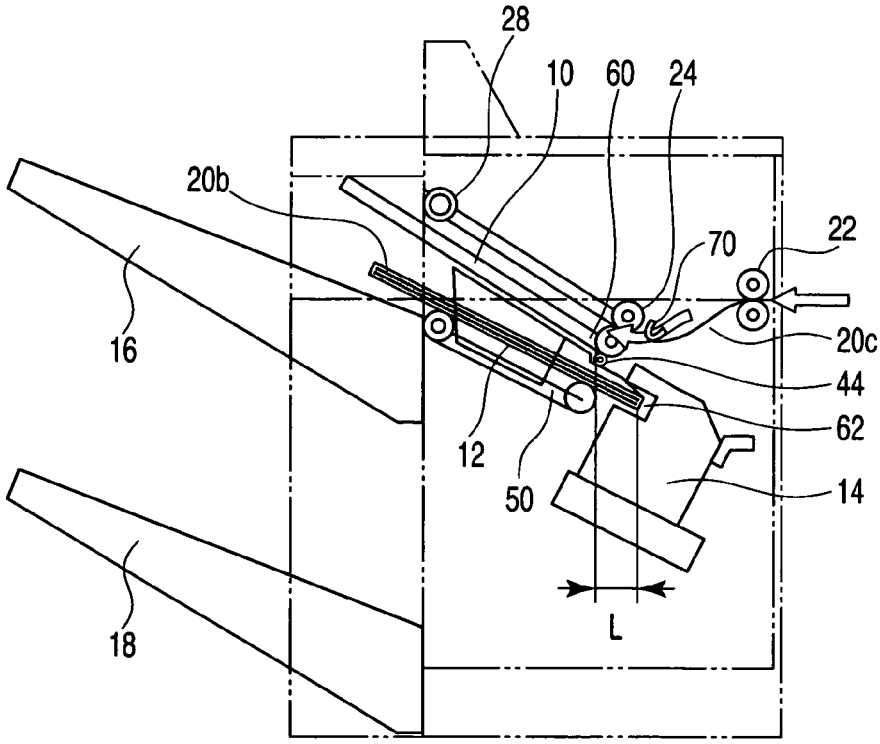
FIG. 13 is a view illustrating a flow of a third sheet of sheets in the post-process apparatus showing one embodiment of the invention.

A state in which the second sheet is held on the processing tray 12 will be first described. In the processing tray 12, a predetermined number of bundles of sheets 21 are formed to be held on two bundles of sheets 20*b*. At this time, the longitudinal and transverse alignment mechanisms 38 and 47 function, and longitudinal and transverse sheet alignments are executed. At this time, as shown in FIG. 13, the distal end 60 of the waiting tray 10 and a distal end 62 (upstream side) of the processing tray 12 are spaced in a transverse direction with a distance L so that the distal end 60 of the waiting tray 10 exists on the downstream side more than the distal end 62 of the processing tray 12. With such a construction, the bundle of sheets 20*b* can be easily dropped from the waiting tray 10 to the processing tray 12, and an aligning operation using the longitudinal and transverse alignment mechanisms 38 and 47 can be easily made. As a result, an occurrence of jamming can be prevented.

The processing tray 12 is allocated to be obliquely inclined together with the waiting tray 10. Thus, the distal ends 60 and 62 of the respective trays are located at the lowest position, and the sheet 20 and the bundle of sheets 21 can be aligned with the distal ends 60 and 62 by its own weight of the sheet 20 and the bundle of sheets 21.

Figure 14:
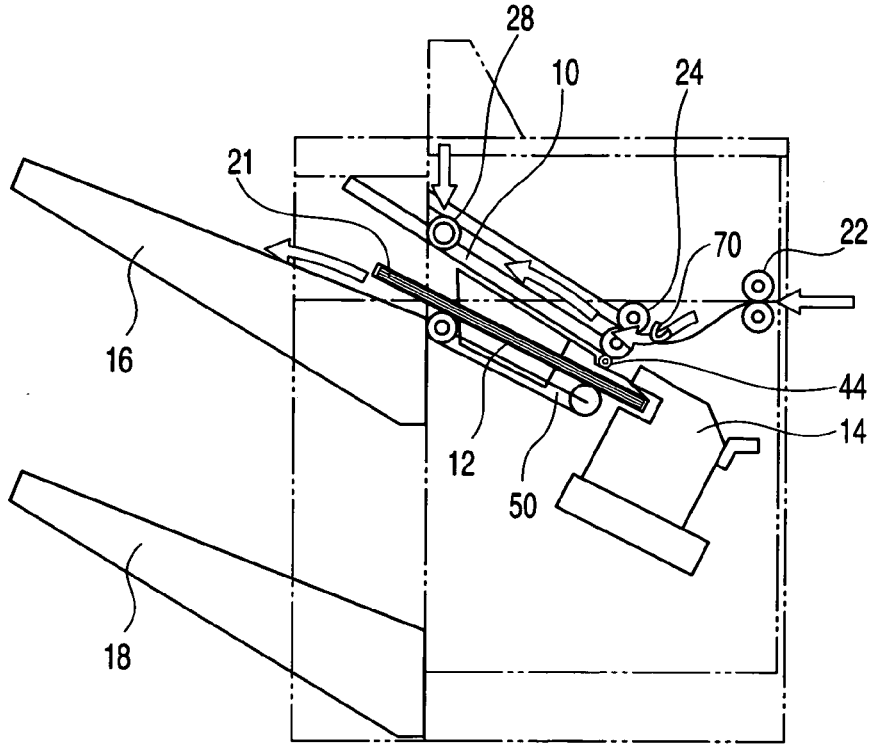
FIG. 14 is a view illustrating an operation of a stapler in the post-process apparatus showing one embodiment of the invention.
Figure 15:
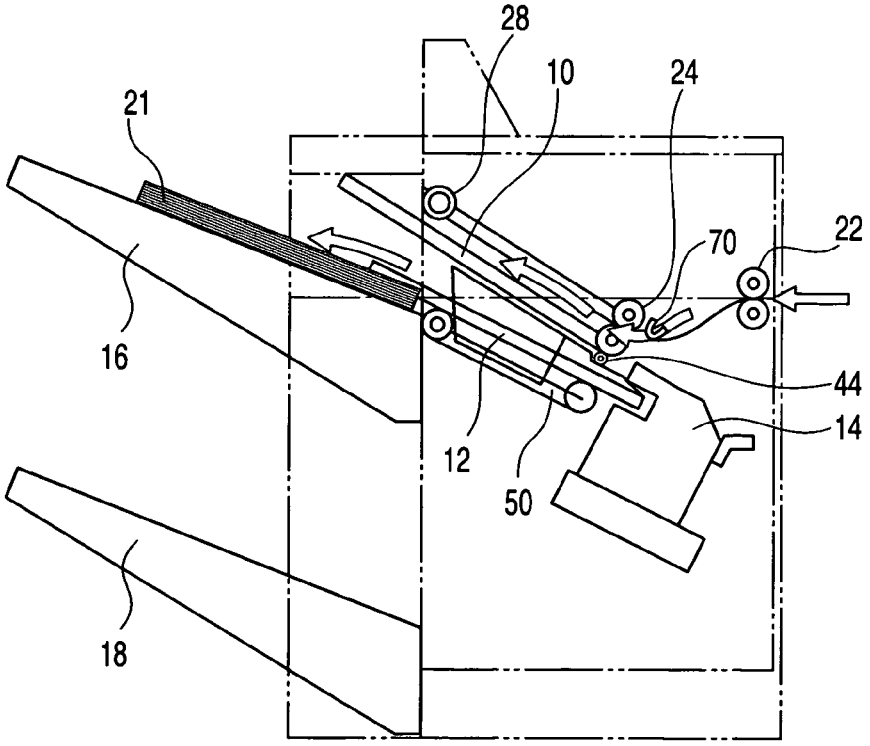
FIG. 15 is a view illustrating a flow of a bundle of sheets between a processing tray and a storage tray in the post-process apparatus showing one embodiment of the invention.

Next, as shown in FIG. 14, the bundle of sheets 21 is staple processed by the stapler 14. Then, as shown in FIG. 15, the bundle of sheets 20 is fed to the storage tray 16 by the transport mechanism 50, and post process terminates.

<Processing in Case Where No Post Process is Carried Out>

Figure 16:
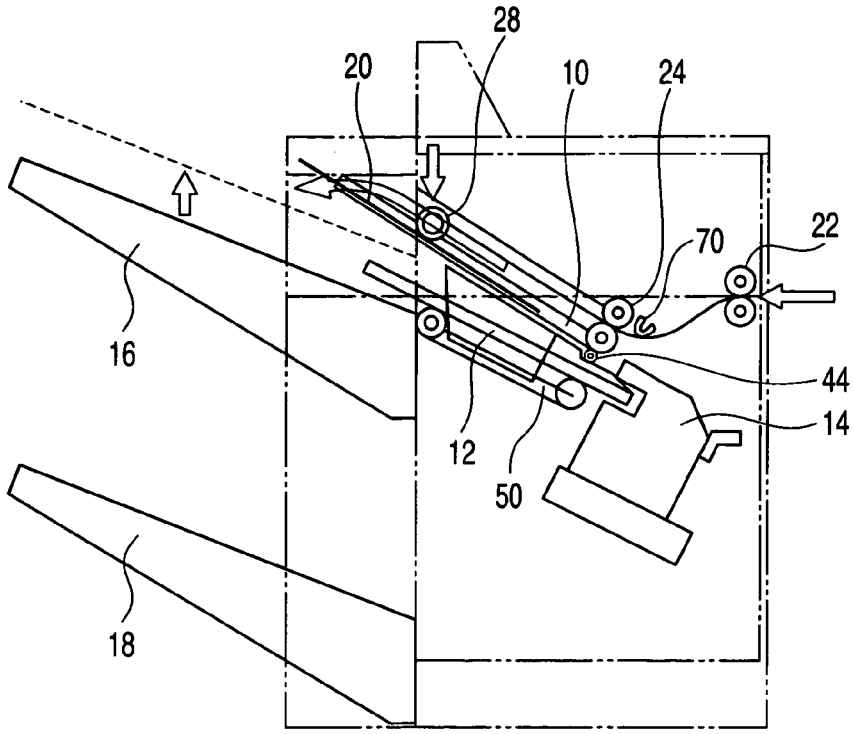
FIG. 16 is a view illustrating a flow of direct sheet ejection of a sheet from the waiting tray to the storage tray in the post-process apparatus showing one embodiment of the invention.
Figure 17:
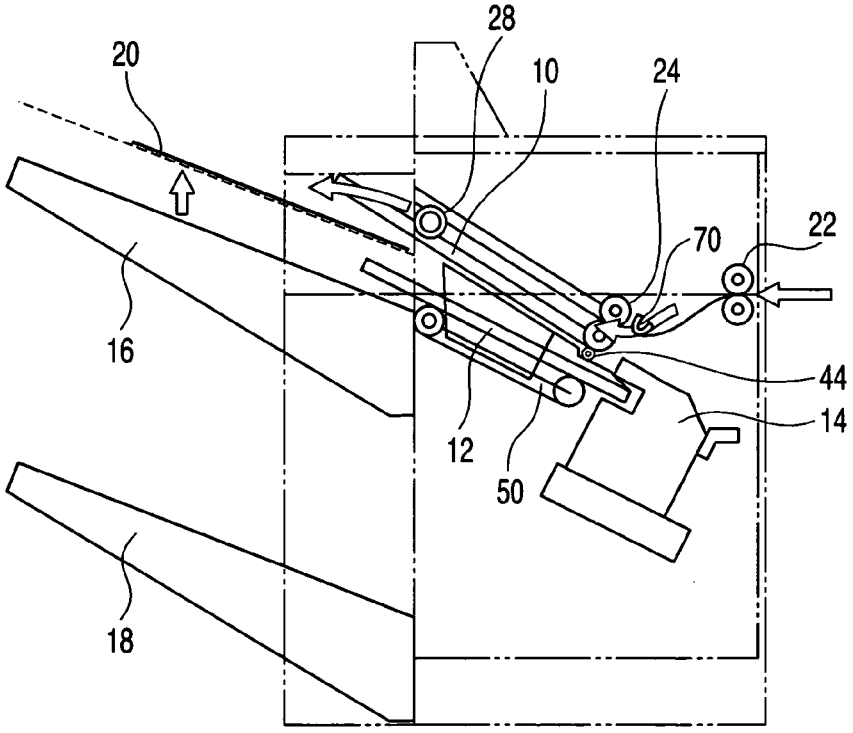
FIG. 17 is a view illustrating an operation of a position change of the storage tray in the post-process apparatus showing one embodiment of the invention.

In the case where no post process is carried out (such as a case in which no staple processing is carried out or a case in which jamming occurs), as shown in FIGS. 16 and 17, a sheet is ejected from the waiting tray 10 directly to the storage tray 16 without intervening the processing tray 12. As shown in FIG. 16, the sheet fed from the image processing apparatus is fed to the storage tray 16 via the inlet roller 22, the paper feed roller 24, and the waiting tray 10. The storage tray 16, as shown in FIG. 17, is slightly risen by the storage tray drive unit 52 to receive the sheet fed from the waiting tray 10.

Although the embodiments of the present invention have been described above, the present invention is not limited to the embodiments. Constituent elements shown in the embodiments can be changed to other constituent elements as long as they have same functions.

What is claimed is:

1. A sheet post process apparatus, the apparatus comprising:

a waiting tray to temporarily retain a transported sheet in a waiting mode and release the support to drop the sheet;

a processing tray to align and hold the sheet dropped from the waiting tray; and a storage tray to hold the sheet processed by the processing tray, wherein the waiting tray comprises:

left and right lower face support members which support left and right lower faces in a sheet transport direction during retention in a waiting mode and release the support of a sheet distal end lower face of the left and right lower faces during release of the retention;

a distal end lower face support member which supports a distal end lower face in a sheet transport direction during retention in a waiting mode and releases the support on the sheet distal end lower face during release of the retention;

an alignment paddle member which aligns distal ends of the sheets held on the processing sheet during sheet alignment on the processing tray; and a rotary shaft allocated in association with a distal end face in the transport direction of the sheet retained in a waiting mode, and the rotary shaft moves the distal end lower face support member from a standby retention location to a retention release location by coaxially mounting and rotating the distal end lower face support member and paddle member, and moves the paddle member to a location in which the sheets are aligned.

2. A sheet post process apparatus according to claim 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are short in length of a sheet transport direction thereof than a length of a standard sheet to be held, and a part of the proximal end side in the transport direction of the sheet to be held on the processing tray is held on the storage tray.

3. A waiting tray for use in a sheet post process apparatus, for temporarily retaining a transported sheet in a waiting mode and releasing the support to drop the sheet onto a processing tray, the waiting tray comprising:

left and right lower face support members which support left and right lower faces in a sheet transport direction during retention in a waiting mode and release the support of a sheet distal end lower face of the left and right lower faces during release of the retention;

a distal end lower face support member which supports a distal end lower face in a sheet transport direction during retention in a waiting mode and releases the support on the sheet distal end lower face during release of the retention;

an upper face slash member which slashes a sheet distal end upper face in a direction to the processing tray during release of the retention; and a rotary shaft allocated in association with a distal end face in a transport direction of a sheet retained in a waiting mode, wherein the rotary shaft moves the distal end lower face support member from a standby retention location to a retention release location by coaxially mounting and rotating the distal end lower face support member and paddle member, and moves the paddle member to a location in which the sheets are aligned.

4. A waiting tray according to claim 3, wherein the paddle member is made of a soft elastic member, and, in the sheet alignment processing location, the paddle member comes into contact with the sheet on the processing tray in an elastically curved state, and aligns a distal end at a side opposite to the sheet transport direction.

5. A waiting tray according to claim 3, wherein the distal end lower face support member and the paddle member are allocated on the same peripheral face of the rotary shaft at an angle of 180 degrees.

6. A sheet post process apparatus, the apparatus comprising:

waiting means for temporarily retaining a transported sheet in a waiting mode and releasing the support to drop the sheet;

processing means for aligning and holding the sheet dropped from the waiting means; and storage means for holding the sheet processed by the processing means, wherein the waiting means comprises:

left and right lower face support means for supporting left and right lower faces in a sheet transport direction during retention in a waiting mode and releasing the support of a sheet distal end lower face of the left and right lower faces during release of the retention;

distal end lower face support means for supporting a distal end lower face in a sheet transport direction during retention in a waiting mode and releasing the support on the sheet distal end lower face during release of the retention;

alignment means for aligning distal ends of the sheets held on the processing means during sheet alignment on the processing means; and a rotary shaft allocated in association with a distal end face in the transport direction of the sheet retained in a waiting mode, and the rotary shaft moves the distal end lower face support member from a standby retention location to a retention release location by coaxially mounting and rotating the distal end lower face support member and paddle member, and moves the paddle member to a location in which the sheets are aligned.

* * * * *